US006341751B1

(12) United States Patent
Herzog

(10) Patent No.: US 6,341,751 B1
(45) Date of Patent: Jan. 29, 2002

(54) ADJUSTABLE HOLDER FOR WATCHES AND JEWELRY

(76) Inventor: Jack L. Herzog, 5702 Durocher Street, Montreal (CA), H2V 3Y2

( * ) Notice: Subject to any disclaimer, the term of this patent is extended or adjusted under 35 U.S.C. 154(b) by 0 days.

(21) Appl. No.: 09/534,986

(22) Filed: Mar. 27, 2000

Related U.S. Application Data

(63) Continuation-in-part of application No. 09/455,913, filed on Dec. 7, 1999, now abandoned.

(51) Int. Cl.[7] ..... A47F 7/00
(52) U.S. Cl. ..... 248/114; 206/301
(58) Field of Search ..... 248/115, 114, 248/116; 206/18, 301, 566; 368/316

(56) References Cited

U.S. PATENT DOCUMENTS 4,082,183 A * 4/1978 Sturm ..... 206/301
4,293,943 A * 10/1981 Avery et al. ..... 248/116 X
5,136,557 A * 8/1992 Plawker et al. ..... 248/116 X
5,181,608 A * 1/1993 Herzog ..... 206/301
5,377,822 A * 1/1995 Herzog ..... 206/301 X
5,779,206 A * 7/1998 Harris et al. ..... 248/214

* cited by examiner

*Primary Examiner*—Ramon O. Ramirez
(74) *Attorney, Agent, or Firm*—Connolly Bove Lodge & Hutz

(57) ABSTRACT

The present invention provides an adjustable watch support or holder. The support comprises a first support element. A second support element is slidably engaged with the first support element. The first and second support elements are moveable between various positions with respect to each other. A lock communicates with the first and second support elements and to secure them a desired position. In a preferred embodiment, the first and second support elements together form a substantially C-shaped element onto which a wrist watch may be removably placed.

18 Claims, 6 Drawing Sheets

ADJUSTABLE HOLDER FOR WATCHES AND JEWELRY

This is a continuation-in-part of U.S. patent application Ser. No. 09/455,913, filed on Dec. 7, 1999 now abandoned.

FIELD OF THE INVENTION

The present invention relates to a support for displaying watches and jewelry, and is more particularly concerned with an adjustable holder that is used to secure the watch or jewelry, regardless of length or diameter.

BACKGROUND OF THE INVENTION

Watch and jewelry display packages previously known generally include C-shaped support members which are surrounded by the watch and watch band. Examples of prior art display packages are shown in FIGS. 1A, 1B and 10A. A C-shaped collar 1 is provided on an insert 4 to support the watch. The watch is simply slipped around the C-collar 1 for display. A pair of slits 6 are provided at opposite ends of the C-collar 1 to receive the watch band.

Watches come in a wide variety of styles and designs, with some watches having long bracelets, some short bracelets, and some having stiff round bangle bracelets. The prior art C-collar cannot be adjusted to fit any particular watch, if the diameter of the watch is to large, the watch will slip off the collar, if the diameter of the watch is too small, the C-collar must be squeezed together to accommodate the watch and may snap. Also, the size of the slits 6 limits the width of the watch bracelet which can be accommodated.

To overcome these problems, the metal bracelet or leather band of the watch must be adjusted to the approximate size of the prior art C-collar before the watch may be placed on the C-collar. This procedure is very costly in terms of labor. Also, when a salesperson removes the watch from the collar to show the watch to a customer, the watch is not always properly placed back onto the collar as it is not adjusted to the proper size. This results in the watch not being displayed properly.

Thus, the many varieties of watches available have created a problem with displaying watches. Moreover, as the watch is simply slipped around the C-collar, if the package is jostled or is turned upside down during shipping, the watch will invariably fall off its support. This may result in the watch becoming damaged during shipping. In some cases, a "twist-tie" is used to secure the watch to the holder to prevent this problem. However this technique is not aesthetically pleasing.

Additionally, because of the ease with which the watch can be slipped onto and off of the C-collar, a problem has arisen with watches displayed in known watch boxes being stolen. A thief may easily slip the watch off of the C-collar. The thief then need not worry about concealing a large, bulky watch box, but only the watch. The thief then closes the box so the theft is not noticed until hours or days later when the watch or jewelry is shown again.

Therefore, there is a need for a watch and jewelry holder which secures the watch and jewelry to prevent theft and damage to the article and which can accommodate watches and jewelry of various sizes.

SUMMARY OF THE INVENTION

The present invention provides an adjustable watch support or holder. The support comprises a first support element. A second support element is slidably engaged with the first support element. The first and second support elements are moveable between various positions with respect to each other. A lock communicates with the first and second support elements and to secure them a desired position. In a preferred embodiment, the first and second support elements together form a substantially C-shaped element onto which a wrist watch may be removably placed.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

The present invention may utilize a generally C-shaped support member to retain a wrist watch. The C-shaped member includes first and second support elements which together comprise an elongated flat central segment that merges at opposing ends into a pair of end portions that are positionally displaced from the central segment. The end portions may each be curved, may exhibit the same or different curvatures, may exhibit curvature of the same or different extents and may in some cases take the form of end portions that are displaced with little if any curvature and with the same or different extents. All of these various arrangements, and others which will be apparent to those skilled in the art, are considered to be "C-shaped" support members that can be used in the present invention.

Figure 1A:
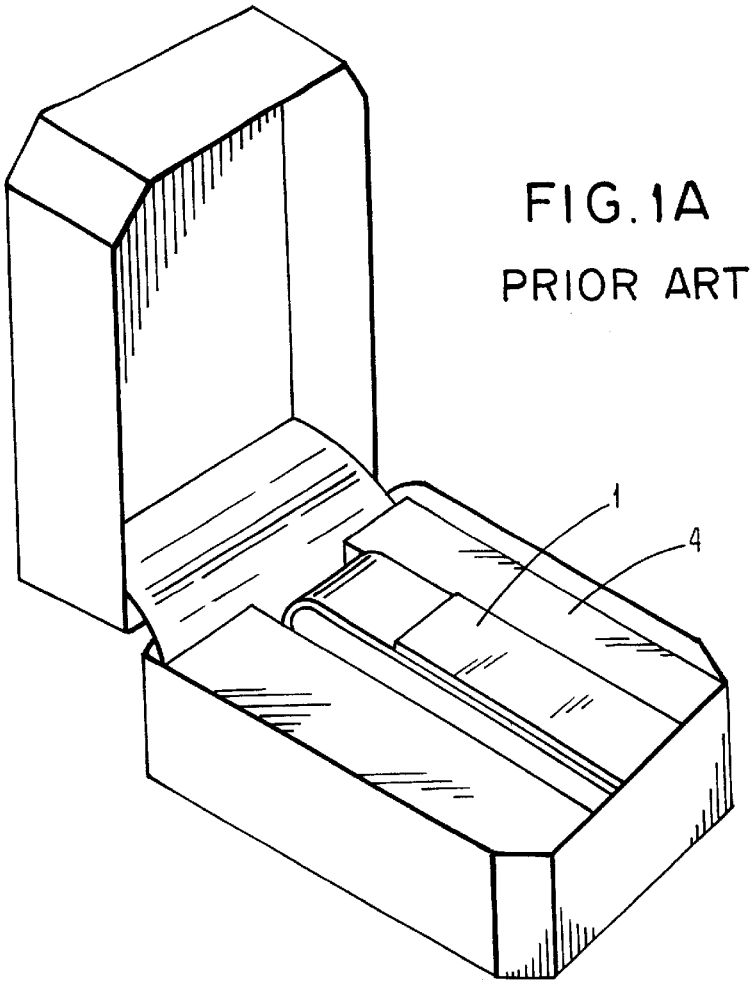
FIG. 1A PRIOR ART
FIGS. 1A, 1B and 10A illustrate known watch holders.
Figure 1B:
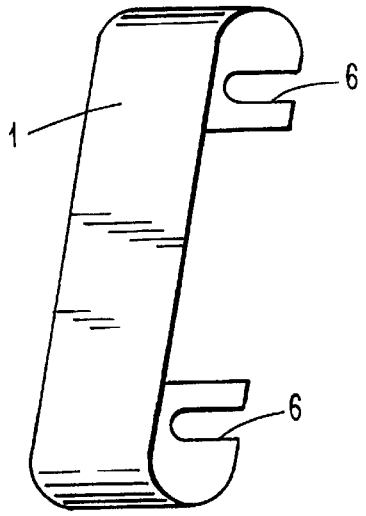
FIG. 1B PRIOR ART
Figure 2:
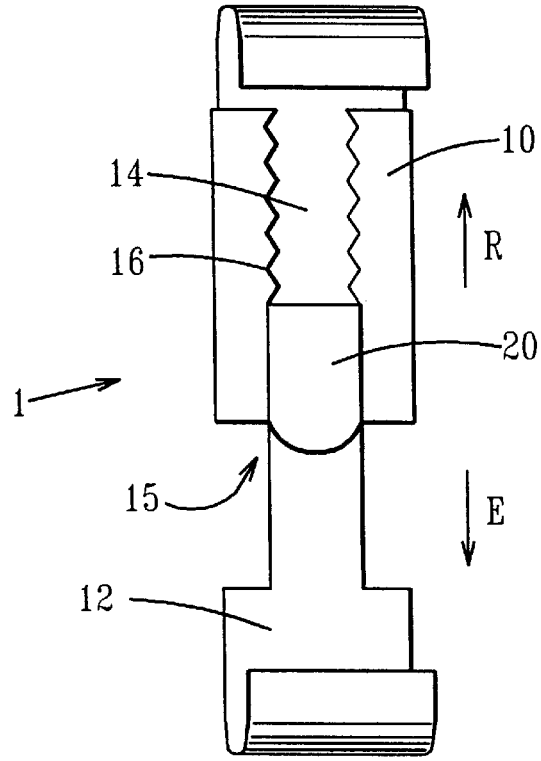
FIG. 2 illustrates a first embodiment of the present invention.

Turning now to FIG. 2, an embodiment of the present invention will now be described. First 10 and second 12 support elements form the C-shaped support member 1. Each of the support elements 10, 12 preferably includes one of the curved end portions. The first and second support elements 10, 12 are moveable with respect to each other. This allows the C-shaped support member to be adjusted to fit watch bracelets of various lengths and widths. The first and second support elements 10, 12 are preferably slidably engaged with each other to accomplish this movement. In this embodiment, the first support element 10 has a recess 14 with a number of indentations 16 formed by sidewalls thereof. The second support element 12 includes an extension 15 which is received in the recess 14. The extension 15 is held within the recess 14 so that the extension 15 may slide within recess 14. A lock 20, preferably arranged on extension 15, communicates with the indentations 16 to hold the first and second support elements 10, 12 in a desired position with respect to each other.

Figure 5A:
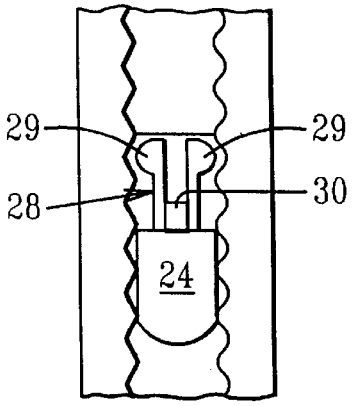
FIGS. 5A and 5B illustrate a detail of the lock.
Figure 5B:
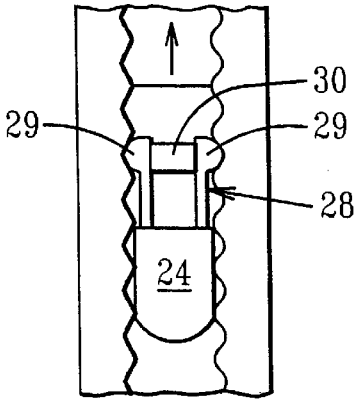

A detail of one embodiment of the lock is shown in FIGS. 5A–5B. Here, the sidewalls of the recess 14 have a zig-zag pattern forming the indentations 16. The lock 20 includes first 24 and second 26 portions arranged on the extension 15. Two prongs 28 extend from the first portion 24 of the lock 20. Each of the prongs 28 has a knob 29 at its end. The second portion 26 of the lock includes a block element 30 arranged between the prongs 28. The second portion 26 may be moved with respect to the first portion 24 between an unlocked and a locked position, as shown in FIGS. 5A and 5B respectively. In the locked position, the block element 30 is moved between ends of the prongs 28 and is snapped into place. The block element 30 forces the ends of the prongs 28 away from each other and pushes the knobs 29 into indentations 16 in opposite sidewalls of the recess 14. The contact between the knobs 29 and the indentations 16 holds the first and second support elements 10, 12 in a desired position. In the unlocked position, the block element 30 is moved away from the knobs 29 as shown in FIG. 5A. In this position, the prongs 28 are released from the indentations 16 and the first and second support elements 10, 12 may be moved to another position. The second portion 26 of the lock 20 is preferably designed to be operated with a person's finger and has an area adapted to receive a finger. Thus, the locking and unlocking operations can be accomplished with a flip of a finger.

Figure 4A:
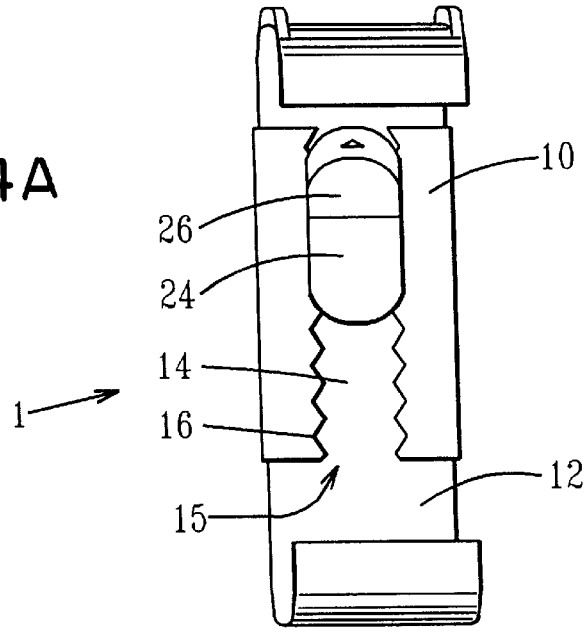
FIGS. 4A–4C illustrate the process of adjusting an embodiment of the present invention.
Figure 4B:
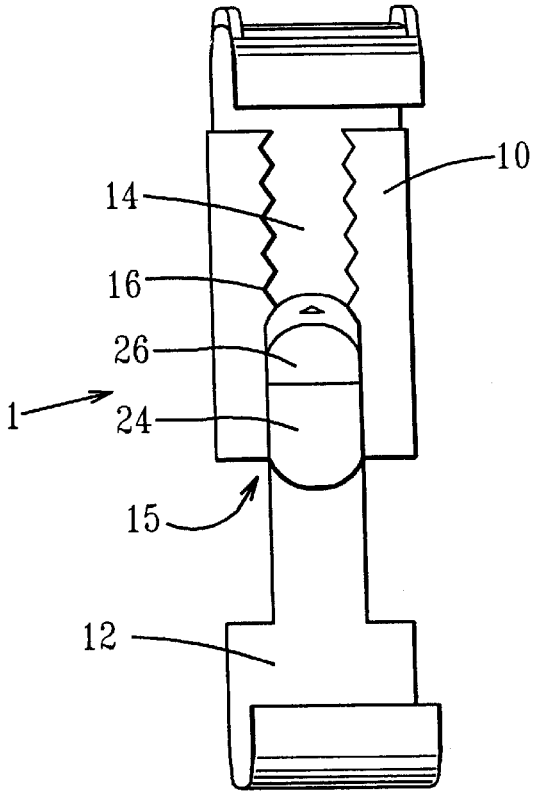
Figure 4C:
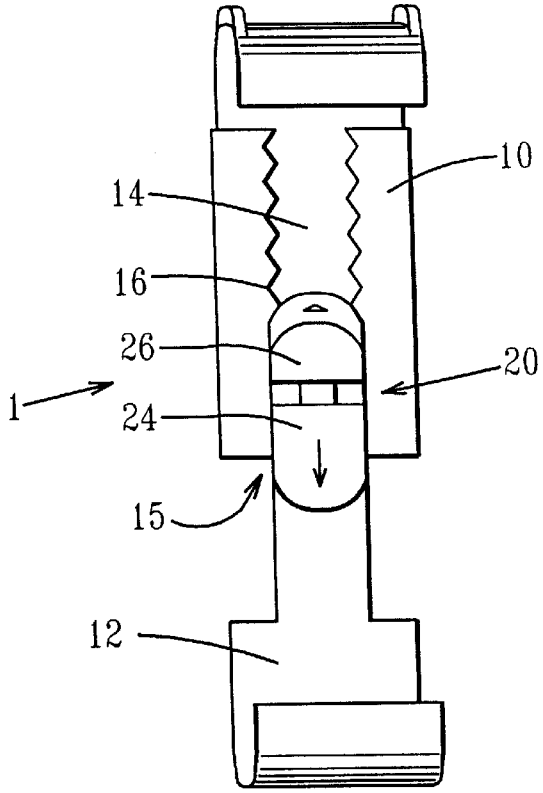

FIGS. 4A–4C show an overview of the process adjusting of the watch holder. FIG. 4A shows the C-collar 1 in an unexpanded or retracted state. Here, the first and second support elements 10, 12 are in their most compacted position. The lock 20 is in the unlocked position and the first and second support elements 10, 12 are therefore freely moveable. In FIG. 4B the first and second support elements 10, 12 are moved to a selected position to fit the diameter of the watch or jewelry. The support elements 10, 12 are held in this selected position by activating the lock 20. A clerk or salesperson applies their finger to the second portion 26 of the lock 20 and moves it to the locked position shown in FIG. 4C. As described above, in the locked position, the block element 30 forces the knobs 29 into the indentations 16 to hold the first and second support elements 10, 12 in place.

Figure 3:
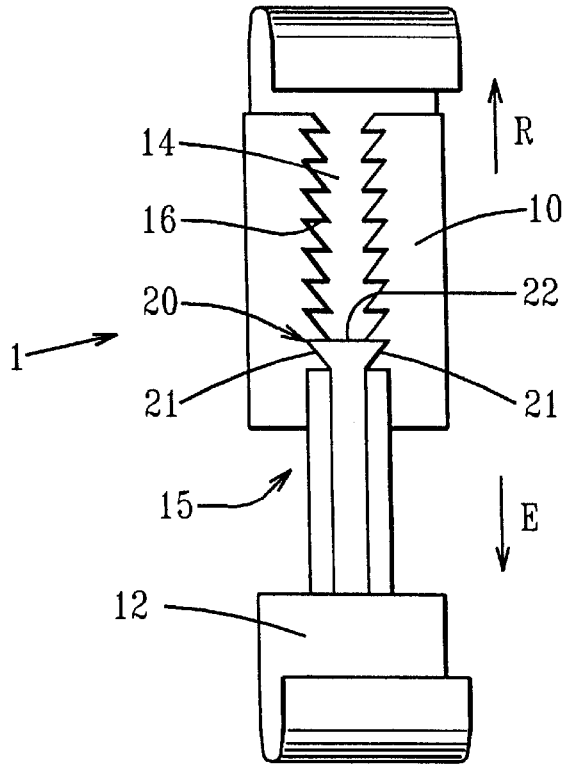
FIG. 3 illustrates a second embodiment of the present invention.

In the embodiment described above, the watch holder is both expandable and retractable. Consequently, once the C-collar is locked in a desired position, it may subsequently be unlocked and set in another position to fit a watch of a larger or smaller diameter. FIG. 3 illustrates another embodiment of the invention in which the C-collar is one way expandable and not retractable. In this embodiment, some of the sidewalls of the recess 14 are angled so the indentations 16 have a somewhat triangular shape. The lock 20 here takes a different form and should be formed to fit into the spaces created by the indentations 16 and should be a portion made from a flexible material. This allows the lock 20 to be compressed as it passes through the indentations 16 when the C-shaped collar is expanded. The also allows the lock 20 to expand and the fill the indentations 16. Angled surfaces 21 of the lock 20 allow the lock 20 to pass in a first, expansion direction E. Surface 22 prevent the lock 20 and the second support element 12 from moving in an opposite, retraction direction R. This embodiment helps prevent theft as the watch or jewelry cannot be removed from the support unless the watch or jewelry is broken.

Figure 8:
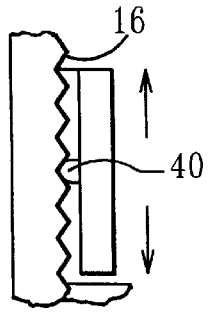
FIG. 8 illustrates another embodiment of the lock.
Figure 6:
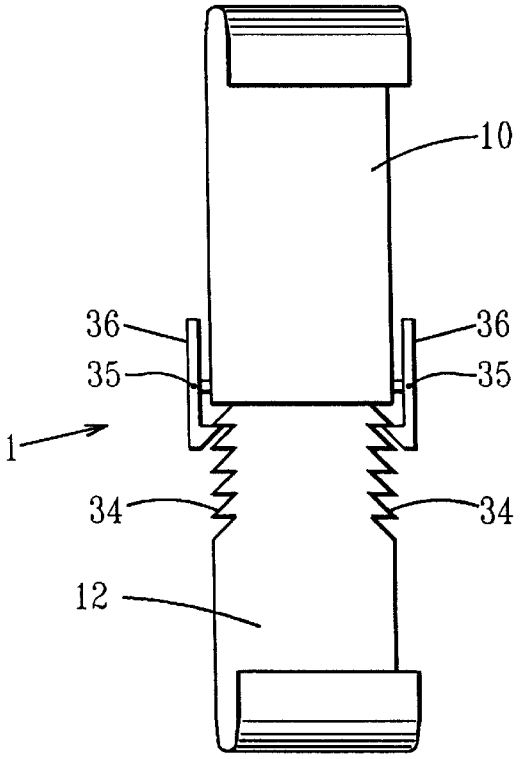
FIG. 6 illustrates another embodiment of the lock.
Figure 7:
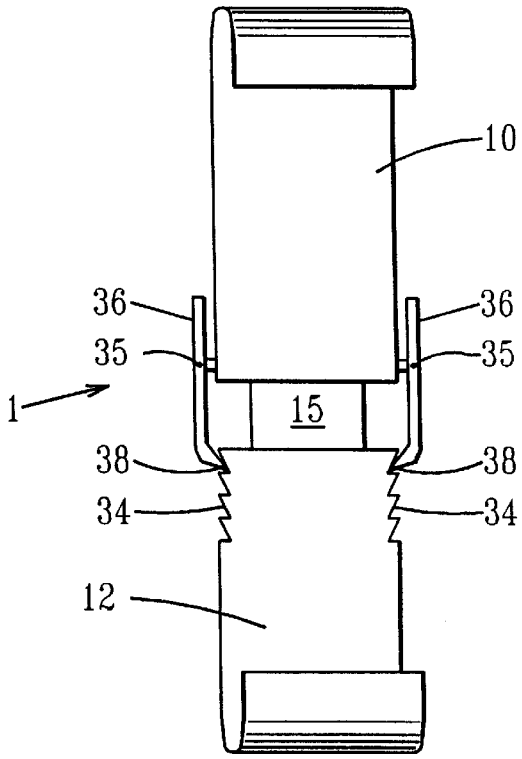
FIG. 7 illustrates another embodiment of the lock.

FIGS. 6–8 show other embodiments of the invention with various locks for the first and second support elements 10, 12. In the embodiment shown in FIG. 6, the second support element 12 is provided with a plurality of indentations 34 along at least portions of its sides. The first support element 10 has side panels 36 which engage the indentations 34. The side panels 36 are preferably flexible and have engaging surfaces 38 which are adapted to be received in the indentations 34, that is engaging surfaces 38 have a shape corresponding to a contour of indentations 34. The salesperson or clerk may use their fingers move the operate side panels 36 and adjust the support. For example, pivot elements 35 may be used to connect the side panels 36 to the first support element 10. A space is provided between ends of the side panels 36 and the first support element 10. The ends of the side panels 36 are depressed to disengage the engaging surfaces 38 from indentations 34, thereby permitting the holder to be adjusted.

Of course, the indentations 34 and engaging surfaces 38 may have a number of different shapes. In FIG. 7, the indentations 34 are formed with angled surfaces facing away from the first support element 10, the opposite of that shown in FIG. 6. In the embodiment shown in FIG. 7, the engaging surfaces 38, again adapted to be received in the indentations 34 prevent the C-shape collar from being contracted unless the lock is released.

Another form of the lock is shown in FIG. 8. Here the lock includes a spring 40 arranged on the second support element 12. The spring 40 expands into and grabs the indentations 16 to hold the first and second support elements 10, 12 in place. When the support elements are to be moved, the spring contracts to allow free movement of the first and second support elements 10, 12.

Figure 9A:
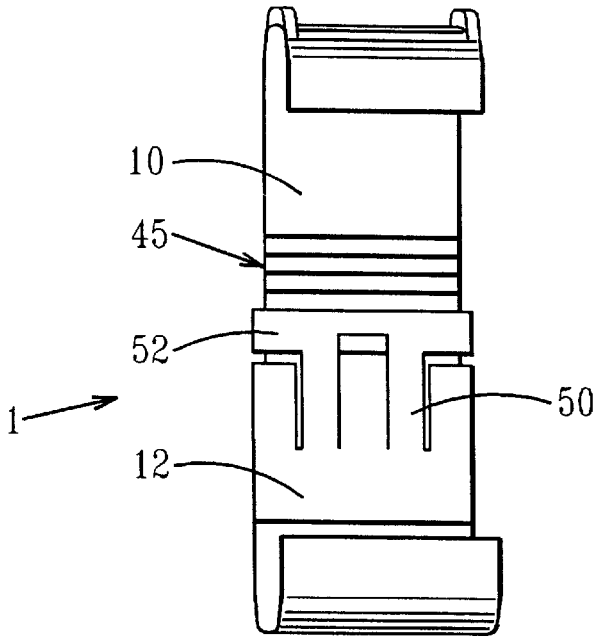
FIGS. 9A–9C illustrate a third embodiment of the present invention.
Figure 9B:
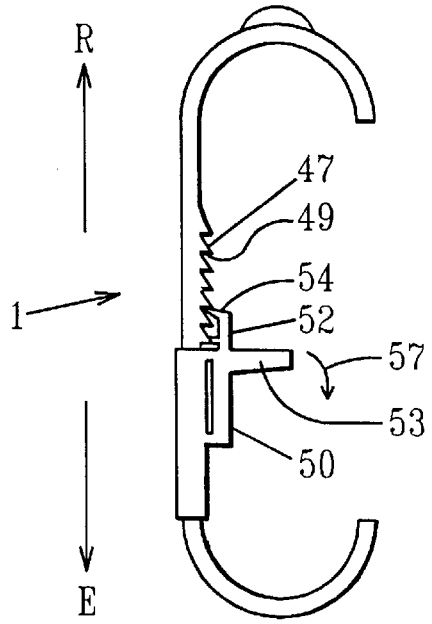
Figure 9C:
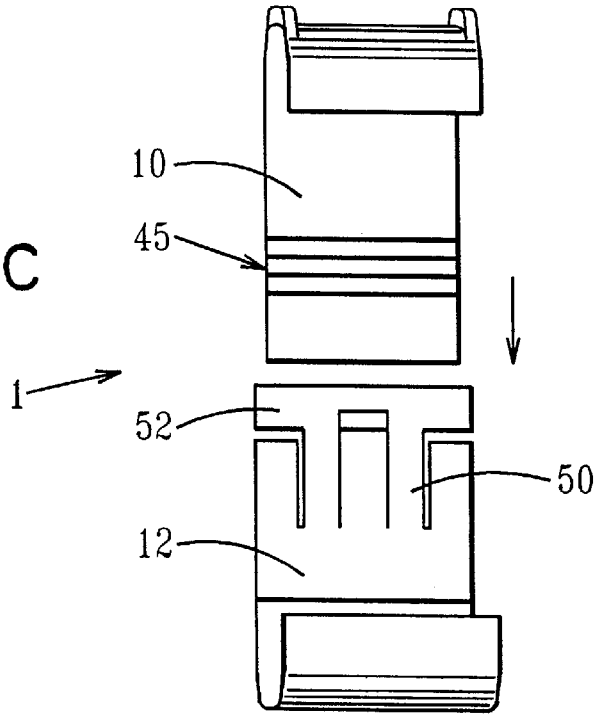

FIGS. 9A–9C illustrate a third embodiment of the present invention. The third embodiment is similar to the embodiments described above in that the first and second support elements 10, 12 are slidably engaged with each other, for example, the first support element 10 may be received in a recess in second support element 12. In the third embodiment, ridges 45 are provided on one of the support elements, here, the first support element 10. A lock is provided on the other of the support elements. The lock preferably prevents the second support element 12 from being moved with respect to the first support element in at least one of the directions shown in FIG. 9B. The ridges 45 should be arranged substantially perpendicular to the direction of movement of the device as shown in FIG. 9C. The ridges 45 are preferably formed from an alternating pattern of angled surfaces 47 and straight surfaces 49 as shown in FIG. 9B. Angled surfaces 47 should slope away from the second support element 12 and straight surfaces 49 should extend substantially perpendicular from the surface of the first support element 10. The lock is received between these surfaces and the device is prevented from being compressed by interaction of the lock with one of the straight surfaces 49, thereby preventing removal of a watch or other item on the device.

The lock is attached to the second support element 12 by tabs 50, as shown in FIG. 9A. The tabs 50 are preferably made form a flexible material so that the first support element 12, with ridges 45, can slide under the lock. The lock has a first surface 52 extending from the tabs 50 and inter-acting with the ridges. First surface 52 should also be arranged substantially perpendicular to the adjusting direction of the device. First surface 52 preferably has a pointed or otherwise tapered end 54 whose shape should correspond to a contour of ridges 45. End 54 is forced into the ridges 45 by the tabs 50 to hold the first and second support elements 10, 12 in place. As shown in FIG. 9B, this is done by interaction between end 54 and straight surface 49. The lock may be released by applying force on stub 53 in the direction of arrow 57 in FIG. 9B. End 54 is thereby released from ridges 45 and the second support element 12 may now be moved in retraction direction R. The angled surfaces 47 and flexibility of the tabs 50 allow the device to be expanded with out deactivating the lock. When second support element 12 is moved in expansion direction E, end 54 simply slides up angled surface 47 and into the next ridge 45. Thus, the alternating pattern of angled surfaces 47 and straight surfaces 49 used here prevent the device from being retracted without using the lock, but allow the device to be easily expanded. Sloping angled surfaces 47 towards second support element 12 has the opposite effect. Of course, other arrangements of the ridges may also be used to prevent any movement of the support elements without deactivating the lock.

Figure 10A:
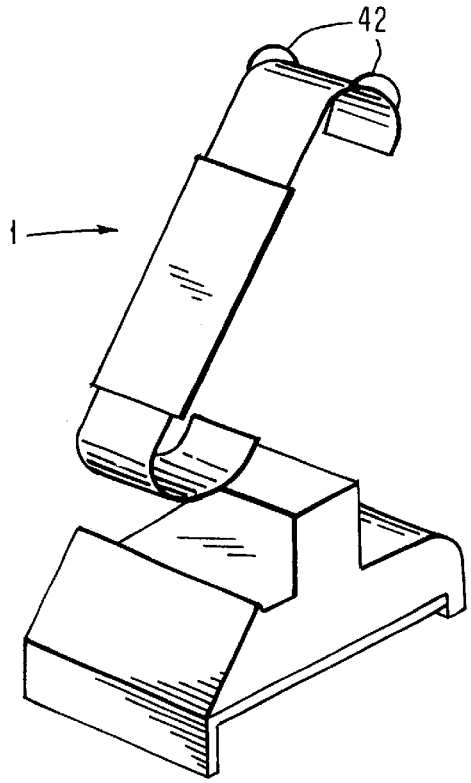
FIG. 10A PRIOR ART
Figure 10B:
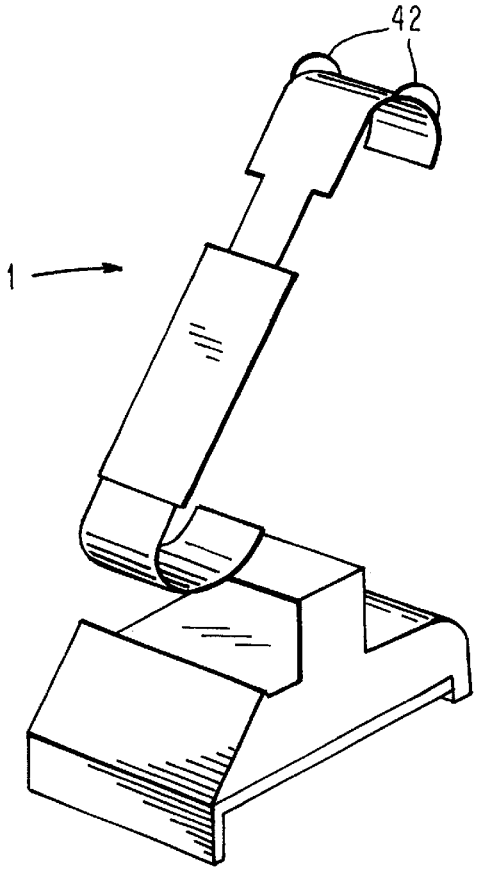
FIG. 10B illustrates a preferred embodiment of the invention.

In a preferred embodiment of the invention, ears 42 are provided on the C-shaped collar as shown in FIGS. 10A and 10B. The ears preferably extend from the curved end portions of the C-shaped collar. The ears 42 are provided to prevent the watch from slipping of the collar. Traditionally, there was a very limited size the ears could be made. If the ears were too long, it was difficult to place the watch on the collar. If the ears were too short, the watch simply falls off the collar. The present invention allows the ears to be long enough to securely hold the watch on the collar. The adjustability of the C-shaped collar allows the watch to easily be placed on the collar when the collar is in the collapsed state. The collar can then be expanded and the watch is held securely in place.

FIGS. 10A and 10B also show the adjustable watch holder as part of a watch stand or display stand. However, the adjustable holder of the present invention may also be adapted to fit in a traditional watch box.

Accordingly, a watch and jewelry holder which supports a watch or jewelry has been provided. In one embodiment, the C-shaped support is formed from first and second support elements. The first and second support elements are slidably engaged with each other to be moveable to various positions. A lock or hook-in may be provided to secure the support elements in a selected position. The support is thus adjustable to fit watches of various length and diameters. Additionally the support is easy to operate and deters theft.

While a preferred embodiment of the invention has been described above, since variations in the invention will be apparent to those skilled in the art, the invention should not be construed as limited to the specific embodiments described above.

I claim:

1. A watch support comprising:

a first support element;

a second support element slidably engaged with the first support, wherein the first and second support elements are moveable between various positions with respect to each other;

a lock communicating with the first and second support elements and securing them in one of the positions, and wherein the first and second support elements together form a substantially C-shaped element onto which a wrist watch may be removable placed.

2. The watch support of claim 1 further comprising ears provided on at least one of the first and second support elements.

3. The watch support of claim 1 wherein the first support element defines a recess extending a longitudinal direction and the second support element has an extension received in the recess.

4. The watch support of claim 3 wherein the recess has side walls, each side wall having a plurality of indentations for engaging the lock.

5. The watch support of claim 4 wherein the lock is arranged on the second support element and comprises first and second portions moveable in the recess with respect to each other, prongs extending from the first portion and an actuator arranged on the second portion, the actuator being moveable with respect to the prongs between a locked and an unlocked position, in the locked position the actuator forces the prongs into the indentations and in the unlocked position the prongs are disengaged from the indentations such that the first and second elements are moveable.

6. The watch support of claim 5 wherein the actuator has a portion adapted to receive a finger.

7. A watch support of claim 5 wherein the second portion has a plurality of indentations, each with a second engaging surface, along its sides and the lock comprises a pair of side panels provided on sides of the first support element, the side panels having first engaging surfaces which face and interact with the second engaging surfaces.

8. The watch support of claim 7 wherein the second engaging surface faces away from the first support element.

9. The watch support of claim 7 wherein the second engaging surface faces towards the first support element.

10. The watch support of claim 4 wherein the lock comprises an engaging portion extending from the second support element and being received in the indentations, the engaging portion and the indentations having surfaces arranged perpendicular to a direction of movement of the first and second support elements which interact with each other whereby the first and second support elements are moveable in only one direction.

11. The watch support of claim 4 wherein the lock comprises springs attached to the second support element in the recess, the springs communicating with the indentations.

12. A watch support comprising:

a first support element having a plurality of ridges thereon;

a second support element slidably engaged with the first support, wherein the first and second support elements are moveable between various position with respect to each other; and a lock arranged on the second support element, the lock interacting with the ridges and preventing the first and second support elements from being moved in at least a first direction with respect to each other, wherein the first and second support elements together form a substantially C-shaped element onto which a wrist watch may be removable placed.

13. The watch support of claim 12 wherein the ridges are formed by a alternating pattern of angled and straight surfaces on the first support element.

14. The watch support of claim 12 further comprising ears provided on at least one of the first and second support elements.

15. The watch support of claim 13 wherein the angled surfaces slope away from the second support element.

16. The watch support of claim 13 wherein the lock comprises:

resilent tabs attached at a first end to the second support element, the tabs extending towards the first support element;

a tapered portion arranged at a second opposite end of the tabs, the tapered portion being forced into engagement with the ridges by the tabs.

17. The watch support of claim 16 wherein the tapered portion communicates with one straight surface to prevent movement of the first and second support element in at least the first direction with respect to each other.

18. The watch support of claim 13 wherein the lock further comprises a stub which can be moved to release the tapered portion from the ridge.

* * * * *